US005235299A

United States Patent [19]

Vaille et al.

[11] Patent Number: 5,235,299

[45] Date of Patent: Aug. 10, 1993

[54] LOW LOSS COAXIAL CABLE

[75] Inventors: Francois Vaille, Corbeil Essonnes; Michel Dunand, Vigneux sur Seine, both of France

[73] Assignee: Filotex, Draveil, France

[21] Appl. No.: 854,688

[22] Filed: Mar. 20, 1992

[30] Foreign Application Priority Data

Mar. 21, 1991 [FR] France ..... 91 03445

[51] Int. Cl.[5] ..... H01P 3/06

[52] U.S. Cl. ..... 333/243; 156/47; 174/105 R; 174/110 F; 174/110 FC

[58] Field of Search ..... 333/243, 244; 156/47, 156/48; 174/102 R, 105 R, 110 R, 110 F, 110 FC, 126.4, 131 A

[56] References Cited

U.S. PATENT DOCUMENTS 3,309,455 3/1967 Mildner ..... 174/131 A X
4,859,258 8/1989 Maréchal et al. ..... 156/51

FOREIGN PATENT DOCUMENTS 0140757 5/1985 European Pat. Off. .
2189825 1/1974 France .
2487568 1/1982 France .
35804 2/1989 Japan ..... 333/243

*Primary Examiner*—Paul Gensler
*Attorney, Agent, or Firm*—313h2ue, Mion, Zinn Macpeak & Seas

[57] ABSTRACT

A low loss coaxial cable has a central supporting rod of plastic, covered in metal and forming the inner conductor or core of the coaxial cable. An intermediate insulation made of a dielectric material surrounds the inner conductor and an outer metal conductor surrounds the intermediate insulation. The central rod is made of polytetrafluoroethylene (PTFE) having a relative density greater than or equal to 1.6. The intermediate insulation has a relative density less than 1.2 and the ratio of the density of the dielectric constituting the intermediate insulation divided by the density of the PTFE constituting the rod lies in the range of 0.15 to 0.75.

14 Claims, 1 Drawing Sheet

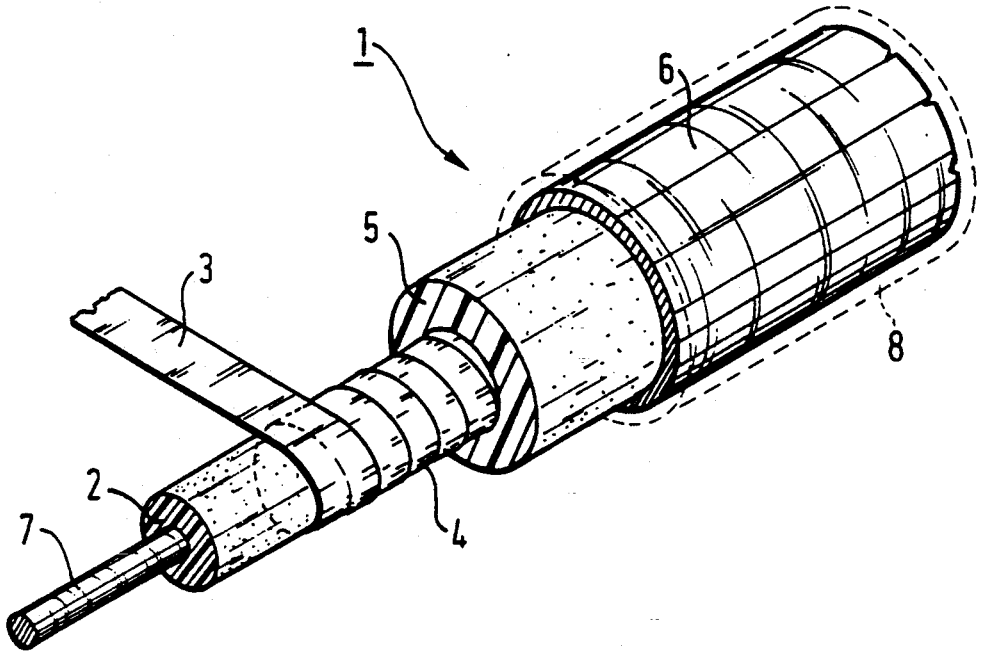
1
6
5
3
8
2
7
4

LOW LOSS COAXIAL CABLE

The present invention relates to a low loss coaxial cable, for operating in particular at very high frequencies and at high temperatures.

BACKGROUND OF THE INVENTION

In order to reduce transmission losses in coaxial cables, a low density dielectric is used as an intermediate insulator (having a minimum density equal to about 15% of the density of the dielectric in a coaxial cable having a solid dielectric). For example, solid polytetrafluoroethylene (PTFE) may be replaced by expanded PTFE, giving a density that is lower than that of solid PTFE. The relative permittivity of expanded PTFE is lower than that of solid PTFE. Consequently, to retain electrical characteristics that are identical to those of conventional cables, and in particular to retain a similar characteristic impedance (it being recalled that the characteristic impedance of a cable depends on the concentricity of the various parts of the cable, on the ratio of their diameters, and on their relative dielectric permittivities), it is necessary to reduce the ratio between the inside diameter of the outer conductor (i.e. generally the outside diameter of the intermediate dielectric) and the outside diameter of the inner conductor, which in practice means that the outside diameter of the inner conductor needs to be increased.

However, when a cable is in use, it is subjected to numerous bending stresses: there is an ever increasing demand for cables taking up as little room as possible for the purpose of saving space, particularly in aviation, military, space, etc. applications.

Thus, increasing the outside diameter of a solid and stiff metal internal conductor while simultaneously reducing the compression strength of a low density dielectric has the effect during bending of the central conducting core being locally decentered because of its stiffness. This gives rise to a harmful change in the characteristic impedance and thus in the electrical properties of the cable in question.

A cable of such a structure cannot be subjected to radii of curvature that are less than four to five times the outside diameter of the cable.

It might be thought that it would be possible to use a cable in which the stiff metal central conductor is replaced by a flexible rod made of dielectric material and covered in strips of metal. Such a structure is described in Patent FR-2 487 568.

However, the solution provided by such a structure cannot be transposed to very high frequencies (typically greater than 12 GHz) where very small diameter cables are used (outside diameter down to 6.5 mm), nor can it be transposed to high operating temperatures (about 125° C. and higher). The cellular polyurethane used for forming the supporting rod described in the patent mentioned above cannot withstand temperatures higher than 80° C.

In addition, using a strip of metal disposed lengthwise and possible welded to make the inner conductor gives rise to a structure which is stiff and which does not accept small radii of curvature: on bending, the inner conductor is damaged.

For cables operating at high frequencies (e.g. 200 MHz), the thickness of metal required for the inner conductor may be of the order of one hundredth of a millimeter (with the minimum thickness e being a function of frequency f in accordance with the following equation:

$$e = \sqrt{(2/2\pi f\sigma\mu)}$$

where $\mu$ is the permeability of the metal used and $\sigma$ is its conductivity). This cannot be obtained using the method of injecting polyurethane into a metal tube constituting the central core as described in the abovementioned patent. It is not possible to make a metal tube having a wall thickness of a few hundredths of a millimeter that is capable of withstanding polyurethane injection. In practice, the cables described in the abovementioned patent have diameters of more than about ten millimeters. Finally, it is not possible using conventional techniques to obtain a cable that accepts small radii of curvature while giving rise to low transmission losses, and being capable of operating at very high frequencies and at high temperatures.

The object of the present invention is thus to provide a low loss cable capable of accepting small radii of curvature and capable of being used at very high frequencies and under high temperatures.

SUMMARY OF THE INVENTION

To this end, the present invention provides a low loss coaxial cable comprising:

a central supporting rod of plastic, covered in metal that forms the inner conductor (or core) of said coaxial cable;

intermediate insulation made of a dielectric material; and an outer metal conductor;

wherein said central rod is made of polytetrafluoroethylene (PTFE) having a relative density greater than or equal to 1.6, said intermediate insulation having a relative density less than 1.2, and the ratio of the density of the dielectric constituting said intermediate insulation divided by the density of the PTFE constituting said rod lying in the range 0.15 to 0.75.

Advantageously, said rod is made by extruding solid PTFE onto a support having a diameter lying in the range 0.15 times to 0.50 times the diameter of said rod. Said support may be: a twisted metal strand, a metal wire, or a filament of insulating material.

In an advantageous embodiment, said rod is made of solid PTFE with a relative density equal to 2.16, and said intermediate insulation is made of expanded PTFE with a relative density equal to 1.

According to an important feature, said metal inner conductor may be obtained by helically taping a conductive tape around said rod at a short pitch and without welding. Said taping may then be performed with overlap lying in the range 20% to 60%.

In a variant, said inner conductor is obtained by depositing metal on said rod by vapor deposition in a vacuum, cathode sputtering, or chemically.

Also advantageously, the thickness of the inner conductor made in this way lies in the range 0.002 mm to 0.2 mm, depending on the utilization frequency of the cable and on the metallization technique used.

Finally, the cable may also include an outer insulating sheath around the outer metal conductor.

BRIEF DESCRIPTION OF THE DRAWING

An embodiment of the invention is described by way of example with reference to the accompanying drawing, in which the sole FIGURE is a perspective view of a cable of the invention.

DETAILED DESCRIPTION

In the FIGURE, a cable 1 of the invention is constituted by a rod 2 of solid PTFE of relative density $d_J$ equal to 2.16 and having a diameter of 0.93 mm. The rod 2 is made by extruding PTFE onto a copper wire 7 having a diameter of 0.28 mm. It is covered with a conductive copper tape 3 constituting the conductive core 4 of the cable 1. More precisely, the core 4 is made by helically winding non-welded turns of tape 3 at a very short pitch and with 49% overlap. The resulting metallization thickness is 0.1 mm, which allows the cable to operate at 40 MHz and above.

The intermediate dielectric 5 constituted by expanded PTFE having a relative density $d_I$ equal to 1 is taped around the conductive core 4. The diameter of the intermediate insulation 5 obtained in this way is 2.95 mm. Finally, conventional techniques that are not part of the present invention are used to add an outer conductor 6 which is a metal tube having a diameter of 3.58 mm. The outside diameter of the cable 1 is thus 3.58 mm. It is not compulsory to provide the cable 1 with an outer insulator 8. The outer conductor 6 may then optionally be tinned or silver-plated.

The ratio $d_I/d_J$ is equal to 0.46. It lies within the range defined above, i.e. within the range 0.15 to 0.75. Thus, with a cable of the invention, it is possible to achieve a radius of curvature that is three times the outside diameter of the cable 1, i.e. about 10 mm, without decentering the core and thus without changing the electrical characteristics of the cable, whereas the minimum radii of curvature achieved with prior art cables are of the order of four or even five times the outside diameter of the cable. In the context of the invention, reducing the minimum radius of curvature is limited only by the maximum mechanical stress that the outer conductor can accept on bending.

In addition, the use of PTFE to form the supporting rod makes it possible for the cable to operate at high temperatures, and in general temperatures above 125° C.

Because the inner conductor is taped without welding and at a very short pitch on the supporting rod, the structure of the conductive core is flexible, thereby enabling the minimum radius of curvature to be reduced.

It is also possible to achieve metallization by depositing metal on the rod by vapor deposition in a vacuum, by cathode sputtering, or chemically. It is thus possible to obtain metallization that is very thin (a few microns) which allows a cable of the invention to be used at very high frequencies (with a metallization thickness of 5μ, the cable at can be used at frequencies above 200 MHz).

Finally, and advantageously, the copper wire which is not used as a conductor, serves as a flexible support during extrusion of the supporting rod and provides mechanical reinforcement for the structure while ensuring that the stiffness of the rod is low enough to avoid disturbing the electrical characteristics of the cable during possible bending.

The present invention thus makes it possible to obtain cables having low transmission losses and capable of accepting small radii of curvature while conserving their electrical characteristics, and simultaneously being capable of operating at very high frequencies and at high temperatures.

Such cables may be used, in particular, in military, space, or aviation applications, and in any other field where constraints on bulk require cables to be subjected to tight crowding.

Naturally the present invention is not limited to the structure described above.

In particular, the supporting rod may be made by extruding PTFE on a flexible mechanical reinforcement support that is made of metal or otherwise. For example, the support could be constituted by a metal wire or twisted strand having a diameter lying in the range 0.15 times to 0.5 times the diameter of the rod.

Similarly, the relative density of the dielectric constituting the intermediate insulator may lie in the range 0.3 to 1.2. Nevertheless, it is necessary for the ratio of the density of the intermediate insulation to the density of the supporting rod to remain within the range 0.15 to 0.75 in order to retain the properties of a cable of the invention.

In addition, the overlap rate of the taping may lie in the range 20% to 60%.

Finally, the thickness of the inner conductor advantageously lies in the range 0.002 mm to 0.2 mm. In practice, for cable utilization frequencies higher than 1 GHz, the thickness is about 0.002 mm, and for utilization frequencies greater than 10 MHz, it is about 0.2 mm.

Naturally, any metallization technique could be replaced by an equivalent technique without going beyond the ambit of the invention.

We claim:

1. A low loss coaxial cable comprising:

a central supporting rod of plastic, a metal inner conductor covering said rod;

intermediate insulation made of a dielectric material surrounding said inner conductor; and an outer metal conductor surrounding said intermediate insulation;

and wherein said central rod is made of polytetrafluoroethylene (PTFE) having a relative density greater than or equal to 1.6, said intermediate insulation having a relative density less than 1.2, and the ratio of the density of the dielectric constituting said intermediate insulation divided by the density of the PTFE constituting said rod lying in the range of 0.15 to 0.75, whereby the low loss coaxial cable can operate at continuous temperatures in excess of 125° C., said coaxial cable is sufficiently flexible to accept small radii of curvature while showing low transmission losses even when being bent, said central supporting rod is capable of supporting the inner conductor without having the geometry of the central rod altered and is sufficiently stiff to provide minimal mechanical resistance to flexure of the cable.

2. A cable according to claim 1, wherein said rod is extruded solid PTFE to a support having a diameter lying in the range 0.15 times to 0.50 times the overall diameter of said rod.

3. A cable according to claim 2, wherein said support is one material selected from the group consisting of: metal, and an insulating material.

4. A cable according to claim 1, wherein said rod is solid PTFE having a relative density equal to 2.16.

5. A cable according to claim 1, wherein said intermediate insulation is expanded PTFE having a relative density equal to 1.

6. A cable according to claim 1, wherein said metal inner conductor is an unwelded, helically wound conductive tape about said rod at a short pitch.

7. A cable according to claim 6, wherein said wound conductive tape has an overlap lying in the range of 20% to 60%.

8. A cable according to claim 1, wherein said inner conductor is a vacuum metal vapor deposit on said rod.

9. A cable according to claim 1, wherein said inner conductor is cathode sputtered metal deposit on said rod.

10. A cable according to claim 1, wherein said inner conductor is chemical metal deposit on said rod.

11. A cable according to claim 1, wherein the thickness of said inner conductor lies in the range 0.002 mm to 0.2 mm.

12. A cable according to claim 1, further including an outer insulating sheath around said outer metal conductor.

13. A cable according to claim 1, further comprising a tin plating on said outer conductor.

14. A cable as claimed in claim 1, further comprising a silver plating on said outer conductor.

* * * * *